US008595967B1

(12) United States Patent
Cook et al.

(10) Patent No.: US 8,595,967 B1
(45) Date of Patent: Dec. 3, 2013

(54) BAND HAVING RIBBING ON BOTH ENDS

(71) Applicant: Intermountain Business Forms, Inc., Centerville, UT (US)

(72) Inventors: Jerry C. Cook, Centerville, UT (US); Michael J. Hirst, Bountiful, UT (US); Jared Hurst, Centerville, UT (US)

(73) Assignee: Intermountain Business Forms, Inc., Centerville, UT (US)

( * ) Notice: Subject to any disclaimer, the term of this patent is extended or adjusted under 35 U.S.C. 154(b) by 0 days.

(21) Appl. No.: 13/646,511

(22) Filed: Oct. 5, 2012

(51) Int. Cl.
*A44C 5/00* (2006.01)

(52) U.S. Cl.
USPC ..... 40/633; 283/75; 24/265 A; 24/265 WS

(58) Field of Classification Search
USPC ..... 40/633, 300, 304; 283/75; 24/265 A, 24/265 WS, 17 AP
See application file for complete search history.

(56) References Cited

U.S. PATENT DOCUMENTS

| | | | | | |
|---|---|---|---|---|---|
| 2,018,068 | A * | 10/1935 | Kestenman | 63/4 |
| 2,312,045 | A * | 2/1943 | Morin | 24/435 |
| 3,372,500 | A * | 3/1968 | Claude | 40/633 |
| 4,096,688 | A * | 6/1978 | Rieth | 59/79.1 |
| 4,882,813 | A * | 11/1989 | Nakamura | 24/16 PB |
| 5,377,387 | A * | 1/1995 | Freed | 24/16 PB |
| 2008/0148775 | A1 * | 6/2008 | Kaplan | 63/15 |
| 2011/0041370 | A1 * | 2/2011 | Saint et al. | 40/633 |

* cited by examiner

*Primary Examiner* — Kristina Junge
(74) *Attorney, Agent, or Firm* — Kirton | McConkie; Brian Tucker

(57) ABSTRACT

The present invention extends to a band having ribbing on both ends. The exterior surface of the band can include high quality printed content. The ribbing allows the band to be easily shortened equally at both ends so that the printed content can remain centered on the band after shortening. The band can be used as a wristband, belt, collar, or any other type of band to be worn on the human or pet body.

20 Claims, 5 Drawing Sheets

BAND HAVING RIBBING ON BOTH ENDS

CROSS-REFERENCE TO RELATED APPLICATIONS

Not Applicable.

BACKGROUND

Wristbands, straps, bracelets or other jewelry or apparel worn around the wrist (collectively referred to as wristbands) have become a common way of displaying one's support for or endorsement of a cause or effort. For example, the Livestrong wristband has been worn by many individuals in support of the Lance Armstrong Foundation.

Such wristbands can include slogans, logos, or other content to advertise a particular cause or otherwise display one's support. Many of these wristbands are not adjustable such as the silicone gel wristbands. Even if a wristband is adjustable, the adjustments may not be easily made or may result in other undesirable consequences. Additionally, these wristbands are often comprised of porous material that cannot be decorated with high quality printing.

BRIEF SUMMARY

The present invention extends to a band having ribbing on both ends. The exterior surface of the band can include high quality printed content. The ribbing allows the band to be easily shortened equally at both ends so that the printed content can remain centered on the band after shortening. The band can comprise a wristband, belt, collar, or other band worn around a part of the human or pet body.

In one embodiment, a wristband comprises a band of non-porous material on which high quality content can be printed. The band includes a first and a second end. Ribbing is formed at the first and second end thereby allowing the band to be shortened equally at both ends.

In another embodiment, a wearable band comprises a band of non-porous material on which high quality content is printed. The band includes a first and a second end with the high quality content being positioned on the band at a relative distance from the first and second ends. Ribbing is formed at the first and second end thereby allowing the band to be shortened equally at both ends such that the high quality content remains positioned at the relative distance from the first and second ends.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention extends to a band having ribbing on both ends. The exterior surface of the band can include high quality printed content. The ribbing allows the band to be easily shortened equally at both ends so that the printed content can remain centered on the band after shortening. The band can comprise a wristband, belt, collar, or other band worn around a part of the human or pet body.

In one embodiment, a wristband comprises a band of non-porous material on which high quality content can be printed. The band includes a first and a second end. Ribbing is formed at the first and second end thereby allowing the band to be shortened equally at both ends.

In another embodiment, a wearable band comprises a band of non-porous material on which high quality content is printed. The band includes a first and a second end with the high quality content being positioned on the band at a relative distance from the first and second ends. Ribbing is formed at the first and second end thereby allowing the band to be shortened equally at both ends such that the high quality content remains positioned at the relative distance from the first and second ends.

Figure 1:
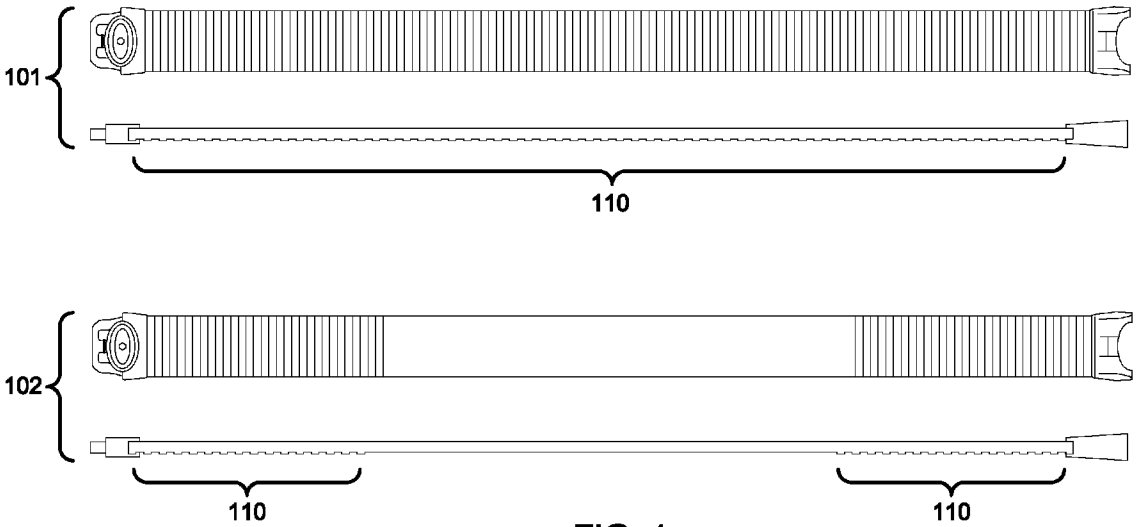
FIG. 1 illustrates various views of two exemplary wristbands that include ribbing on both ends.

FIG. 1 illustrates two views of exemplary wristbands 101 and 102. Each of wristbands 101 and 102 includes ribbing 110 at both ends. As shown, ribbing 110 on wristband 101 extends along the full length of the wristband whereas ribbing 110 on wristband 102 extends only along a portion of each end of the wristband. Ribbing 110 allows a wristband to be easily shortened at both ends equally.

Figure 2:
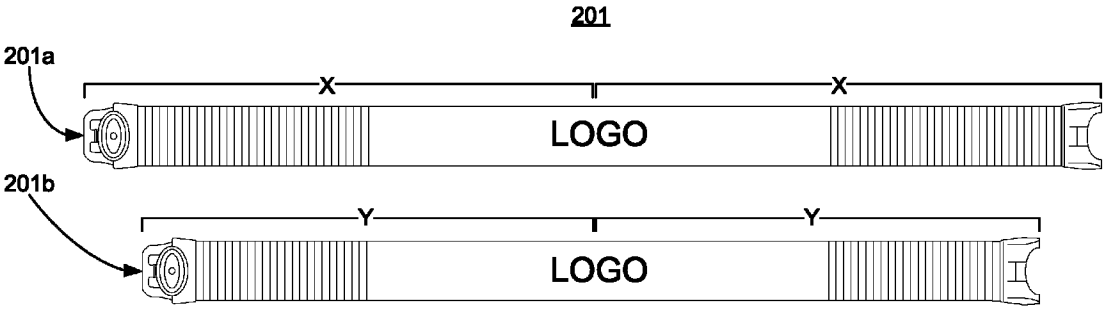
FIG. 2 illustrates how the ribbing allows an exemplary wristband to be shortened equally on both ends.

For example, as shown in FIG. 2, a wristband 201 can include a logo that is centered on the outside surface of the wristband. Wristband 201 can initially be too long for a given person's wrist as shown in 201*a*. However, if wristband 201*a* is shortened on one end only, the logo will no longer be centered. Accordingly, ribbing 110 is provided on both ends to allow the wristband to be shortened equally from both ends as shown in 201*b*. Specifically, the wristband has been shortened by a length X-Y on both ends. In this manner, the logo can be positioned in the appropriate location of a person's wrist regardless of the length to which the wristband is shortened.

Although the exemplary wristbands shown in the Figures are all shown as having sides that are substantially straight and in-line with the connectors, any shape of wristband could be used. For example, shapes can be formed around the portion of the wristband where the logo is printed in FIG. 2 (e.g. a circle, square, or other shape to allow a wider logo to be printed on the band). Also, the sides of the wristband can form multiple different shapes, angles, or contours as desired.

Ribbing 110 facilitates the cutting of the wristband (i.e. by providing areas where the material of the wristband is thinner) and also provides a guide for making an appropriate cut. In some embodiments, the wristband can be made of material that can be cut using standard scissors. This material can have a generally non-porous surface that allows high quality content (e.g. full color printing or CMYK printing) to be printed on the surface of the wristband. In a particular embodiment, the wristbands can be comprised of a Polypropylene homopolymer such as PPU 1080, but the invention should not be limited to wristbands made of PPU 1080.

Traditional wristbands on which content is printed have traditionally been made of silicone or other relatively porous materials. High quality content generally cannot be printed on such substances because of their porosity. Accordingly, wristbands according to embodiments of the present invention may preferably be made primarily of a non-porous material, such as PPU 1080, that allows high quality content to be printed thereon and allows ribbing to be formed therein.

Figure 3:
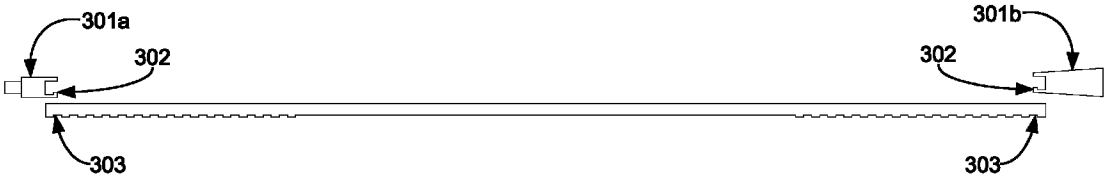
FIG. 3 illustrates exemplary connectors that can be used on a wristband having ribbing on both.

FIG. 3 illustrates exemplary connectors 301 that can be provided with a wristband having ribbing 110 on both ends. Connectors 301 include a protrusion 302 that can be slid into a channel portion 303 of ribbing 110 thereby locking the connector onto the end of the wristband. As shown in FIG. 3, protrusion 302 can be slid into the outermost channel 303 of ribbing 110. Alternatively, connector 301 can be configured such that protrusion 302 can be slid into another channel of ribbing 110. The channels 303 in ribbing 110 can be uniformly sized and spaced such that connectors 301 can be attached to the wristband when the ends of the wristbands are shortened to any length where ribbing 110 is present.

Although not shown, connectors that are configured to connect to the end of the wristband in manners other than by sliding can also be used. For example, connectors can be used that clip, snap, or otherwise attach to the ribbing regardless of the length to which the ribbing is shortened.

Figure 4:
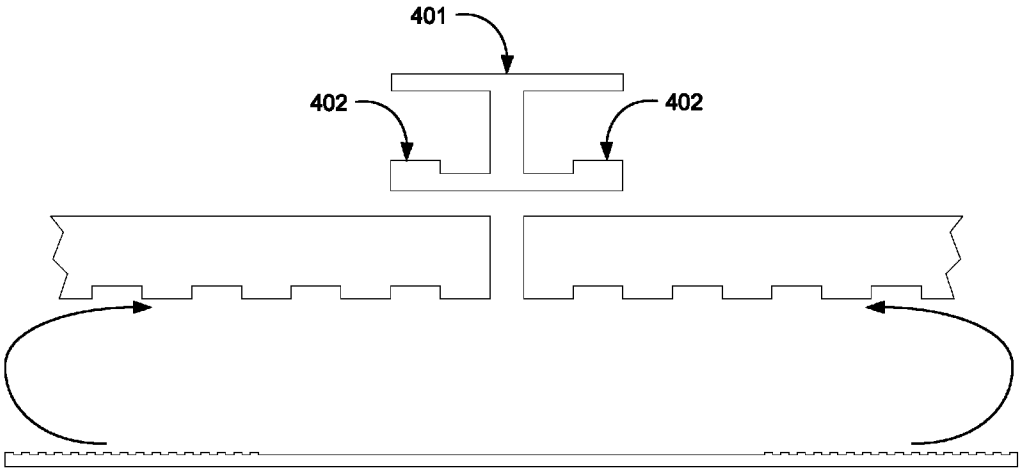
FIG. 4 illustrates an exemplary connector that can be used to secure together a wristband having ribbing on both ends.

FIG. 4 illustrates another exemplary connector 401 that can be provided with a wristband having ribbing 110 on both ends. Connector 401 can include protrusions 402 on both sides such that a single connector 401 can be used to secure both ends of a wristband together as shown. As with connectors 301, protrusions 402 can be slid into corresponding channels in ribbing 110 when the wristband has been shortened.

Figure 5:
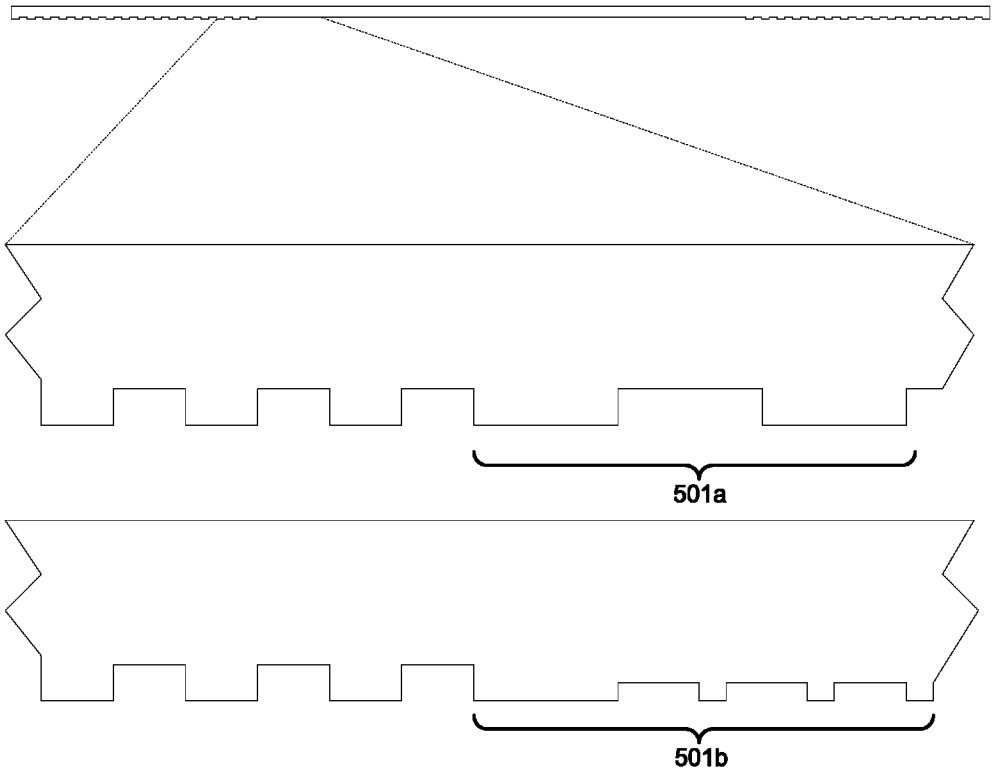
FIG. 5 illustrates exemplary channels that can be formed in a wristband to increase air movement under the wristband when worn.

In some embodiments, as shown in FIG. 5, a wristband can include ventilation channels 501*a*, 501*b*. These ventilation channels can be formed between the ribbing 110 on both ends of a wristband. Ventilation channels 501*a*, 501*b* facilitate airflow underneath the wristband when the wristband is worn. In some cases, especially when the wristband has a relatively larger width, the lack of airflow under the wristband can reduce the comfort of wearing the wristband. In such cases, ventilation channels 501*a*, 501*b* can increase the comfort of wearing such wristbands.

As shown in FIG. 5, the ventilation channels can have different sizes, depths, shapes, or patterns. In some embodiments, when ribbing 110 extends the full length of the wristband (such as in wristband 110 of FIG. 1), the ribbing 110 can comprise ventilation channels.

Although the above description has referred primarily to wristbands, the present invention also extends to the use of ribbing on other types of bands such as belts, dog collars, etc. Further, bands having ribbing on both ends can also be used for purposes other than on the human or animal body. For example, such bands can be used to secure together items (e.g. rope, cords, etc.), decorate items (e.g. as a band around a cup or other object), or any other use. Accordingly, in the description and the claims, the term wristband should be interpreted broadly to include a band that is worn around the wrist, neck, waist, ankle, or any other part of the human or animal body, and may also be interpreted as a band for use with or around any other object.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A wristband comprising:

a band of non-porous material on which high quality content can be printed, the band having a first and a second end;

ribbing formed at the first and second end of the band, the ribbing allowing the band to be shortened equally at both ends, the ribbing at each of the first and second ends comprising a plurality of channels that are each parallel to the first or second end respective;

a first connector having a protrusion that is configured to slide into one of the channels of the ribbing on the first end even when a portion of the ribbing at the first end is cut from the band; and a second connector having a protrusion that is configured to slide into one of the channels of the ribbing on the second end even when a portion of the ribbing at the second end is cut from the band, wherein the first connector is configured to interlock with the second connector.

2. The wristband of claim 1, further comprising high quality content printed on the band, the high quality content being positioned at a relative distance from the first and second ends, wherein the ribbing enables the high quality content to remain at the same relative distance from the first and second end after the band is shortened.

3. The wristband of claim 1, wherein the non-porous material comprises a homopolymer.

4. A wristband comprising:

a band of non-porous) The wristband of claim 3, wherein the homopolymer is a polypropylene homopolymer.

5. The wristband of claim 1, wherein the non-porous material is metal.

6. The wristband of claim 1, wherein the ribbing extends along the full length of the band.

7. The wristband of claim 1, wherein the ribbing extends along a portion of the ends of the band such that a portion of the band between the ribbing contains no ribbing.

8. The wristband of claim 7, wherein the portion of the band between the ribbing includes ventilation channels.

9. The wristband of claim 8, wherein the ventilation channels comprise a uniform pattern of channels.

10. The wristband of claim 8, wherein the ventilation channels comprise a varied pattern of channels.

11. The wristband of claim 1, further comprising high quality content printed on the band, the high quality content being centered between the first and second ends of the band, wherein the ribbing enables the high quality content to remain centered between the first and second ends after the band is shortened.

12. A wearable band comprising:

a band of non-porous material on which high quality content is printed, the band having a first and a second end, the high quality content being positioned on the band at a relative distance from the first and second ends;

ribbing formed at the first and second end, the ribbing allowing the band to be shortened equally at both ends such that the high quality content remains positioned at the relative distance from the first and second ends, the ribbing at each of the first and second ends comprising a plurality of channels that are each parallel to the first or second end respectively; and a connector having a first and a second side, the first side having a protrusion that is configured to slide into one of the channels of the ribbing on the first end even when a portion of the ribbing at the first end is cut from the band such that the first end is contained within the first side of the connector when the protrusion of the first side of the connector is slid into the channel on the first end, the second side having a protrusion that is configured to slide into one of the channels of the ribbing on the second end even when a portion of the ribbing at the second end is cut from the band such that the second end is contained within the second side of the connector when the protrusion of the second side of the connector is slid into the channel on the second end.

13. The wearable band of claim 12, wherein the non-porous material comprises a polypropylene homopolymer.

14. The wearable band of claim 12, wherein the band comprises a wristband, a belt, or a pet collar.

15. The wearable band of claim 12, further comprising high quality content printed on the band, the high quality content being positioned at a relative distance from the first and second ends, wherein the ribbing enables the high quality content to remain at the same relative distance from the first and second end after the band is shortened.

16. The wearable band of claim 12, wherein the ribbing extends along the full length of the band.

17. The wearable band of claim 12, wherein the ribbing extends along a portion of the ends of the band such that a portion of the band between the ribbing contains no ribbing.

18. The wearable band of claim 17, wherein the portion of the band between the ribbing includes ventilation channels.

19. A wristband comprising:

a band of a polypropylene homopolymer material on which high quality content is printed, the band having a first and a second end;

ribbing formed at the first and second end of the band, the ribbing allowing the band to be shortened equally at both ends, the ribbing at each of the first and second ends comprising a plurality of channels that are each parallel to the first or second end respectively, each channel being equally spaced from an adjacent channel;

a first connector having a protrusion that is configured to slide into one of the channels of the ribbing on the first end even when a portion of the ribbing at the first end is cut from the band; and a second connector having a protrusion that is configured to slide into one of the channels of the ribbing on the second end even when a portion of the ribbing at the second end is cut from the band, wherein the first connector is configured to interlock with the second connector.

20. The wristband of claim 19, wherein the first and second connectors are formed of a single component.

* * * * *